US006497746B1

(12) United States Patent
Steeghs et al.

(10) Patent No.: US 6,497,746 B1
(45) Date of Patent: Dec. 24, 2002

(54) PROCESS FOR AGGLOMERATING PARTICULATE MATERIAL

(75) Inventors: Henricus Renier Gerardus Steeghs, Englewood, CO (US); James John Schmitt, Eveleth, MN (US)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 08/032,525

(22) Filed: Mar. 15, 1993

Related U.S. Application Data

(63) Continuation of application No. 07/788,971, filed on Nov. 7, 1991, now abandoned.

(51) Int. Cl.[7] ..... C22B 1/244
(52) U.S. Cl. ..... 75/772
(58) Field of Search ..... 75/772

(56) References Cited

U.S. PATENT DOCUMENTS

| | | | | | |
|---|---|---|---|---|---|
| 3,374,115 | A | * | 3/1968 | Frank et al. | 127/71 |
| 4,288,245 | A | | 9/1981 | Roorda et al. | 75/0.5 |
| 4,402,736 | A | * | 9/1983 | Graham | 264/117 |
| 4,597,797 | A | | 7/1986 | Roorda et al. | 106/194 |
| 4,684,549 | A | | 8/1987 | Allen et al. | 427/221 |
| 4,751,259 | A | * | 6/1988 | Roe et al. | 524/47 |
| 4,863,512 | A | | 9/1989 | Banyai et al. | 75/5 |
| 4,919,711 | A | * | 4/1990 | Banyai et al. | 75/767 |
| 5,000,783 | A | * | 3/1991 | Dingeman et al. | 75/772 |

FOREIGN PATENT DOCUMENTS

| | | | |
|---|---|---|---|
| AU | 46544/85 | | 5/1986 |
| AU | 4654485 | | 5/1986 |
| CA | 890342 | | 1/1972 |
| DE | 2028328 | * | 12/1970 |
| EP | 0203855 | | 3/1986 |
| EP | 0203855 | | 12/1986 |
| EP | 0225171 | | 6/1987 |
| EP | 8800232 | | 1/1988 |
| EP | 0288150 | | 10/1988 |
| EP | 0376713 | | 4/1990 |
| EP | 0376713 | | 7/1990 |
| JP | 7397237 | | 8/1973 |
| SU | 205982 | | 7/1968 |
| WO | 8800232 | | 1/1988 |

OTHER PUBLICATIONS

Derwent Abstract, No. 22.244Q of Romanian Patent No. 203,982, Jul. 1968.

Derwent Abstract, No. 62249Y/35 of Japanese Patent No. 50049103, Aug. 1973.

Hackh's Chemical Dictionary Fourth Edition McGraw–Hill Book Co New York N.Y, 1969 p618 lines 2–9.*

* cited by examiner

*Primary Examiner*—Melvyn Andrews
(74) *Attorney, Agent, or Firm*—Lainie E. Parker; Ralph J. Mancini; Louis A. Morris

(57) ABSTRACT

A process for particulate agglomeration (i.e., pelletizing) and the product produced (i.e., pellets) by such processes are disclosed. The process generally comprises a process of agglomerating particulate material, said process comprising commingling said particulate material with a moistening effective amount of water, a binding effective amount of polymer and a binding effective amount of weak acid to produce a mixture and forming said mixture into agglomerates.

6 Claims, No Drawings

PROCESS FOR AGGLOMERATING PARTICULATE MATERIAL

This is a continuation of application Ser. No. 07/788,971 filed Nov. 7, 1991 now abandoned.

BACKGROUND OF THE INVENTION

The present invention relates to a process for agglomerating particulate material and the products produced by such processes. The processes are particularly useful for agglomerating metallic ores and, most particularly, iron ore.

Processes for agglomerating particles, especially metallic particles, are known in the art. Such processes are described more fully in, e.g. Canadian Patent No. 890 342, issued Jan. 11, 1972. As disclosed in Canadian Patent No. 890 342, it is well known to mechanically agitate water-wet particles to promote the operation of cohesive forces which produces larger agglomerates of the particulate solids. The mechanical agitation may be produced by rolling or cascading motion as is achieved in balling drums, discs and cones. Another agglomeration method utilizes agitation induced by paddle type agitators, such as in pug mills.

As agglomeration proceeds, aggregates in the form of pellets, balls, or granules are formed. As the agglomerates are agitated, e.g. rolled or tumbled, particles are added to their surface as a continuous film. The growth of larger agglomerates is also attributed to coalescence of smaller particles and agglomerates. Sometimes the agglomerates are dusted with finely divided dry particles to minimize sticking problems or sprayed with liquid, e.g. water, if the mixture becomes too dry. When their size is sufficient, the agglomerates are removed from the agitating mechanism for further processing such as induration by heating to low temperatures and sintering at higher temperatures depending upon the utilitarian nature of the starting materials.

International Patent Publication WO 88/00232 discloses a binder for fuels (especially coal) comprised of guar gum. A small amount of citric acid may be optionally added to adjust the pH.

European Patent Application Publication No. 0 376 713 discloses a process for making pellets of particulate metal ore, particularly iron ore. The process comprises mixing a water-soluble polymer with the particulate metal ore and water and pelletizing the mixture. The water-soluble polymer may be of any typical type, e.g., natural, modified natural or synthetic. The mixture may optionally comprise a pelletizing aid which may be sodium citrate.

U.S. Pat. No. 4,288,245 discloses pelletization of metallic ores, especially iron ore, with carboxymethyl cellulose and the salt of a weak acid.

Australian Patent Specification 46544/85 discloses a pelletizing process for iron ore employing hydroxymethyl cellulose and an inorganic salt (e.g. sodium carbonate). Guar gum may be used as a carrier.

European Patent Application Publication No. 0 203 855 discloses a binder comprised of a polymer (especially a polyacrylamide-based polymer) and an inorganic salt such as sodium carbonate. According to this disclosure, the polymer-inorganic salt binder may be used for agglomeration of both "mineral ore" and "coal dust and nonmetallic materials".

U.S. Pat. Nos. 4,863,512 and 4,919,711 disclose iron ore binder compositions comprised of alkali metal salts of carboxymethyl cellulose and/or carboxymethyl hydroxyethyl cellulose and sodium tripolyphosphate. Incidentally, these U.S. patents mention that their binder compositions may contain additional polysaccharides, such as guar and hydroxypropyl guar and inorganic salts, such as sodium citrate and sodium carbonate.

Abstract 22,244Q, 1968, abstracting the U.S.S.R. inventor certificate RU 205982, published July, 1968, discloses a method of preparing mixtures of powders for the production of sintered ferrites. In that process boric acid and sodium carboxymethyl-cellulose are solubilized. Barium ferrite powder is mixed with 6% of the solution, compressed, dried and sintered.

Even in the face of such technical knowledge, there remains a need for economical binders with improved properties.

SUMMARY OF THE INVENTION

In one embodiment, the current invention is a process of agglomerating particulate material, said process comprising commingling said particulate material with a moistening effective amount of water, a binding effective amount of polymer and a binding effective amount of weak acid to produce a mixture and forming said mixture into agglomerates.

In another embodiment, the current invention is a process of agglomerating particulate material, said process comprising commingling said particulate material with (1) a moistening effective amount of water, (2) a binding effective amount of a polymer selected from the group consisting of guar, guar derivatives, starch, modified starch, starch derivatives, alginates, pectins and mixtures thereof and (3) a binding effective amount of the salt of a weak acid to produce a mixture and forming said mixture into agglomerates.

In yet another embodiment, the current invention is pellets comprised of particulate material, a binding effective amount of polymer and a binding effective amount of a weak acid. Optionally, the pellets may be comprised of a polymer selected from the group consisting of guar, guar derivatives, starch, modified starch, starch derivatives, alginates, pectins, and mixtures thereof and the salt of a weak acid.

DETAILED DESCRIPTION OF THE INVENTION

Polymers. The polymers useful in the present invention may be (1) a water-soluble natural polymer, such as guar gum or starch, (2) a modified natural polymer, such as guar derivatives (e.g. hydroxypropyl guar, carboxymethyl guar), modified starch (e.g. anionic starch, cationic starch), starch derivatives (e.g. dextrin) and cellulose derivatives (e.g. hydroxyethyl cellulose, carboxymethyl cellulose, hydroxypropyl cellulose, methyl cellulose), and/or (3) a synthetic polymer (e.g. polyacrylamides, polyacrylates, polyethylene oxides). Such polymers may be used alone or as combinations of two or more different polymers.

The binding effective amount of polymer will vary depending upon numerous factors known to the skilled artisan. Such factors include, but are not limited to, the type of particulate material to be agglomerated or pelletized, the moisture content of the particulate material, particle size, the agglomeration equipment utilized, and the desired properties of the final product, e.g. dry strength (crush), drop number, pellet size and smoothness. Though not limiting, a binding effective amount of polymer will typically be in the range of about 10 to about 99 wt. % and about 40 to about 95 wt. % based on total binder weight.

Acids and Their Salts. The acids useful in the current invention are weak organic or inorganic acids, having degrees of acidity such that their pK is higher than about 3. The pK is defined here as pK=−log K, where K is the dissociation constant of the acid or already dissociated acids at 25° C. in water (see C. D. *Hodgeman, Handbook of Chemistry and Physics*, 30th Ed., 1947, p. 1425). As non-limiting examples of such acids may be mentioned: acetic acid, benzoic acid, lactic acid, propionic acid, tartaric acid, succinic acid, citric acid, nitrous acid, boric acid, carbonic acid, fumaric acid, malic acid and the like.

In certain embodiments of the current invention, use is made from the salts derived from such acids and, for example, alkali metals (e.g. sodium, potassium and lithium,) ammonia, etc. Particularly preferred salts are those derived from alkali metal and citric and or carbonic acid, such as carbonates and bicarbonates and citrates of potassium and sodium. The salts contemplated herein may be used in their hydrated or anhydrous forms. Specific salts of interest are sodium citrate, sodium carbonate, sodium tartrate, sodium bicarbonate, sodium stearate, sodium benzoate, sodium oxalate, sodium acetate, sodium glycolate and the corresponding ammonium, potassium, calcium and magnesium salts of these acids.

A binding effective amount of weak acid or salt of a weak acid, as with the polymer, will depend on many factors well known to the skilled artisan. However, generally, a binding effective amount of weak acid or salt of a weak acid will be about 1 to about 90 wt. % acid and preferably about 5 to about 60 wt. % based on total binder weight.

Binder Addition. The amount of binder, comprised of polymer and weak acid or salt of a weak acid, added to particulate material to be agglomerated will depend on many factors as discussed above. However, a typically effective amount of binder added is 0.01 to about 5.0 wt. %, and preferably about 0.03 to about 0.3 wt. %, of the agglomerating mixture.

The binder may be added in any of the typical physical forms as known by the skilled artisan, e.g. dry, liquid, emulsion, dispersion, etc.

Water. The initial moisture content of the particulate material, polymer and acid or weak acid salt mixture will also depend on many factors known to the skilled artisan. As non-limiting ranges, generally, the water content of such mixture should be about 4 to about 30 wt. % based on the weight of dry particulate matter and most preferably about 7 to about 12 wt. %.

The invention is further described by the following non-limiting examples.

EXAMPLES

Experimental Procedure

For Examples 1-61 and Comparative Examples 1–7, the following procedure and test protocol were followed.

Agglomeration Formation

The process was begun by placing 2500 grams (dry weight) of iron ore concentrate (moisture content approx. 9 to 10 wt. %) into a muller mixer (Model No. 1 Cincinnati Muller, manufactured by National Engineering Co.). The polymer is then added to the mixer and spread evenly over the iron ore concentrate. If a mixture of polymers was used, the mixture was premixed by hand prior to addition to the muller mixer. The loaded mixer was run for three (3) minutes to evenly distribute the polymer. The resulting concentrate mixture was screened to remove particles smaller than those retained on an 8 mesh wire screen.

A balling disc fabricated from an airplane tire (approx. 16"×16") driven by a motor having a 60 RPM rotational speed was employed to produce green balls of the concentrate mixture. Pellet "seeds" were formed by placing a small portion of the screened concentrate mixture in the rotating balling tire and adding atomized water to initiate seed growth. As the size of the seed pellets approached 4 mesh they were removed from the balling disc and screened. The −4+6 mesh seed pellets were retained. This process was repeated if necessary until 34 grams of −4+6 mesh seed pellets were collected.

Finished green balls were produced by placing the 34 grams of −4+6 mesh seed pellets into the rotating tire of the balling disc and adding portions of the remaining concentrate mixture from the muller mixer over a 4 minute growth period. Atomized water was added if necessary. When the proper size was achieved (−0.530 inch, +0.500 inch) concentrate mixture addition ceased and the pellets were allowed a 30 second finishing roll. The agglomerated pellets were removed from the disc, screened to −0.530, +5.00 inch size and stored in an air-tight container until they were tested.

Test Protocol

Drop Number was determined by repeatedly dropping two groups of ten (10) pellets each from an 18 inch height to a steel plate until a crack appeared on the surface of each pellet. The number of drops required to produce a crack on the surface of each pellet was recorded. The average of all 20 pellets was taken to determine the drop number of each agglomerated mixture.

Dry Crush Strength was determined by drying twenty (20) pellets of each agglomerated mixture to measure the moisture content. The dry pellets were then individually subjected to a Chatillon Spring Compression Tester, Model LTCM (25 pound range) at a loading rate of 0.1 inch/second. The dry strength reported for each agglomerate mixture is the average cracking pressure of the twenty pellets.

Examples 1–28

Examples 1–28 demonstrate processes of the current invention employing various polymers with citric acid as binding agents for particulate material; in these cases, iron ore. The properties of the pellets produced by such processes are reported in Table 1.

Examples 29–44

These Examples demonstrate the processes of the current invention when various polymers and various weak acids are used to produce pellets of iron ore. The properties of the produced pellets are contained in Table 2.

Examples 45–57

Examples 45–57 represent the embodiment of the current invention which employs polymer and the salt of a weak acid to agglomerate particulate materials. The results are reported in Table 3.

TABLE 1

Polymer-Citric Acid Binders

| Example | Polymer Type | Polymer Amount (lb) | Citric Acid (lb) | Moisture | Drop # | Dry Crush (lb.) |
|---|---|---|---|---|---|---|
| 1 | Guar | 1.0 | 0 | 10.1 | 9.3 | 2.0 |
| 2 | Guar | 1.0 | 0.1 | 9.9 | 11.0 | 3.3 |
| 3 | Guar | 1.0 | 0.2 | 10.4 | 13.5 | 5.3 |
| 4 | Guar | 1.0 | 0.3 | 10.4 | 16.5 | 6.7 |
| 5 | Guar | 1.0 | 0.4 | 9.4 | 8.0 | 7.8 |
| 6 | Guar | 1.0 | 0 | 10.4 | 9.9 | 2.1 |
| 7 | Guar | 1.0 | 0.1 | 10.4 | 11.0 | 3.5 |
| 8 | Guar | 1.0 | 0.2 | 10.6 | 17.4 | 4.5 |
| 9 | Guar | 1.0 | 0.3 | 10.3 | 14.4 | 6.2 |
| 10 | Guar | 1.0 | 0.4 | 10.3 | 14.4 | 6.7 |
| 11 | CMC | 1.0 | 0 | 10.0 | 9.0 | 3.9 |
| 12 | CMC | 1.0 | 0 | 10.1 | 8.0 | 3.6 |
| 13 | CMC | 1.0 | 0.2 | 10.1 | 8.6 | 5.2 |
| 14 | CMC | 1.0 | 0.2 | 10.2 | 10.9 | 6.6 |
| 15 | CM Guar | 1.0 | 0 | 10.1 | 11.4 | 2.5 |
| 16 | CM Guar | 1.0 | 0.2 | 10.6 | 16.7 | 4.8 |
| 17 | Poly-ethylene oxide | 1.0 | 0 | 10.2 | 13.6 | 0.9 |
| 18 | Poly-ethylene oxide | 1.0 | 0.2 | 10.2 | 16.4 | 1.2 |
| 19 | CMHEC | 1.0 | 0 | 10.0 | 5.3 | 1.3 |
| 20 | CMHEC | 1.0 | 0.2 | 9.8 | 5.9 | 2.8 |
| 21 | HEC | 1.0 | 0 | 10.5 | 17.3 | 3.4 |
| 22 | HEC | 1.0 | 0.2 | 10.5 | 18.3 | 4.5 |
| 23 | Potato Starch | 1.0 | 0 | 8.7 | 2.5 | 3.7 |
| 24 | Potato Starch | 1.0 | 0.4 | 9.0 | 2.8 | 5.9 |
| 25 | Mod. Potato Starch | 1.0 | 0 | 10.4 | 7.4 | 3.9 |
| 26 | Mod. Potato Starch | 1.0 | 0.2 | 10.3 | 9.3 | 6.9 |
| 27 | HP Guar | 1.0 | 0 | 10.0 | 7.1 | 2.6 |
| 28 | HP Guar | 1.0 | 0.2 | 10.3 | 13.0 | 5.1 |

TABLE 2

Polymer-Acid Binders

| Example | Polymer Type | Polymer Amount (lb) | Acid Type | Acid Amount (lb) | Moisture | Drop # | Dry Crush (lb) |
|---|---|---|---|---|---|---|---|
| 29 | CMC | 1.0 | None | 0 | 10.1 | 8.0 | 3.6 |
| 30 | CMC | 1.0 | None | 0 | 10.0 | 9.0 | 3.9 |
| 31 | CMC | 1.0 | Tartaric | 0.2 | 10.6 | 14.0 | 6.0 |
| 32 | CMC | 1.0 | Tartaric | 0.2 | 10.2 | 10.2 | 5.0 |
| 33 | CMC | 1.0 | Malic | 0.2 | 10.1 | 11.3 | 5.8 |
| 34 | CMC | 1.0 | Malic | 0.2 | 10.3 | 11.3 | 4.2 |
| 35 | Guar | 1.0 | None | 0 | 10.0 | 8.8 | 1.9 |
| 36 | Guar | 1.0 | None | 0 | 10.1 | 9.3 | 2.0 |
| 37 | Guar | 1.0 | Tartaric | 0.2 | 9.9 | 10.2 | 4.4 |
| 38 | Guar | 1.0 | Tartaric | 0.2 | 9.0 | 4.3 | 3.9 |
| 39 | Guar | 1.0 | Malic | 0.2 | 10.4 | 15.4 | 4.4 |
| 40 | CM Guar | 1.0 | None | 0 | 10.1 | 11.4 | 2.5 |
| 41 | CM Guar | 1.0 | Tartaric | 0.2 | 9.7 | 10.2 | 4.7 |
| 42 | Potato Starch | 2.0 | None | 0 | 8.7 | 2.5 | 3.7 |
| 43 | Potato Starch | 2.0 | Fumaric | 0.4 | 8.7 | 2.9 | 4.3 |
| 44 | Potato starch | 2.0 | Maleic | 0.4 | 8.7 | 3.4 | 4.8 |

TABLE 3

Polymer-Acid Salt Binders

| | Polymer | | Acid Salt | | | | Dry Crush |
|---|---|---|---|---|---|---|---|
| Example | Type | Amount (lb) | Type | Amount (lb) | Moisture | Drop # | (lb) |
| 45 | Guar | 1.0 | None | 0.0 | 10.1 | 9.3 | 2.0 |
| 46 | Guar | 1.0 | So. Citrate | 0.2 | 9.7 | 8.1 | 3.4 |
| 47 | Guar | 1.0 | So. Citrate | 0.2 | 10.3 | 10.7 | 2.9 |
| 48 | Guar | 1.0 | So. Tartrate | 0.2 | 9.6 | 9.4 | 4.8 |
| 49 | Guar | 1.0 | So. Tartrate | 0.2 | 10.3 | 13.9 | 4.3 |
| 50 | Guar | 1.0 | So. Gluconate | 0.2 | 10.5 | 11.8 | 4.0 |
| 51 | Guar | 1.0 | So. Gluconate | 0.2 | 9.8 | 9.0 | 4.3 |
| 52 | HP Guar | 1.0 | None | 0 | 10.0 | 7.1 | 2.6 |
| 53 | HP Guar | 1.0 | So. Citrate | 0.2 | 10.0 | 10.4 | 4.6 |
| 54 | CM Guar | 1.0 | None | 0 | 10.1 | 11.4 | 2.5 |
| 55 | CM Guar | 1.0 | So. Citrate | 0.2 | 10.2 | 10.8 | 4.2 |
| 56 | Potato Starch | 2.0 | None | 0.4 | 8.7 | 2.5 | 3.7 |
| 57 | Potato Starch | 2.0 | So. Citrate | 0.4 | 8.9 | 3.4 | 5.5 |

The foregoing examples have been presented to provide an enabling disclosure of the current invention and to illustrate the surprising and unexpected superiority in view of known technology. Such examples are not intended to unduly restrict the scope and spirit of the following claims.

We Claim:

1. A process of agglomerating metallic ore, said process comprising commingling said metallic ore with a moistening effective amount of water and a binder consisting of, a binding effective amount of a polymer selected from the group consisting of guar, guar derivatives and mixtures thereof, and a binding effective amount of a weak acid selected from the group consisting of citric acid, malic acid, tartaric acid and mixtures thereof to produce a mixture and forming said mixture into agglomerates.

2. The process of claim 1 wherein said metallic ore is iron.

3. The process of claim 1 wherein said polymer and said weak acid together are about 0.01 to about 1.0 wt. % of said mixture.

4. The process of claim 1 wherein the metallic ore is comprised of iron ore, the polymer is comprised of guar and the weak acid is comprised of citric acid.

5. The process of claim 1 wherein said guar derivative is selected from the group consisting of carboxymethyl guar, hydroxypropyl guar and mixtures thereof.

6. A process of agglomerating metallic ore, said process comprising commingling said metallic ore with a moistening effective amount of water and a binder consisting of, a binding effective amount of guar, guar derivatives or mixtures thereof, and a binding effective amount of malic acid, tartaric acid or mixtures thereof to produce a mixture and forming said mixture into agglomerates.

* * * * *